US010172410B2

(12) United States Patent
Munro et al.

(10) Patent No.: US 10,172,410 B2
(45) Date of Patent: Jan. 8, 2019

(54) FOOTWEAR

(71) Applicant: 29 PS PTY LTD., Broadbeach Waters, QLD (AU)

(72) Inventors: Bradley Andrew Munro, Broadbeach Waters (AU); Aaron Benjamin Jennings, Broadbeach Waters (AU)

(73) Assignee: 29 PS PTY LTD., Broadbeach Waters (AU)

( * ) Notice: Subject to any disclaimer, the term of this patent is extended or adjusted under 35 U.S.C. 154(b) by 44 days.

(21) Appl. No.: 15/418,308

(22) Filed: Jan. 27, 2017

(65) Prior Publication Data

US 2017/0135436 A1 May 18, 2017

Related U.S. Application Data

(63) Continuation-in-part of application No. 14/176,513, filed on Feb. 10, 2014, now abandoned.

(51) Int. Cl.

| | |
|---|---|
| ***A43B 3/12*** | (2006.01) |
| ***A43B 3/24*** | (2006.01) |
| ***A43B 3/10*** | (2006.01) |

(52) U.S. Cl.

CPC ..... *A43B 3/122* (2013.01); *A43B 3/103* (2013.01); *A43B 3/108* (2013.01); *A43B 3/128* (2013.01); *A43B 3/244* (2013.01); *A43B 3/246* (2013.01)

(58) Field of Classification Search

CPC ..... A43B 3/12; A43B 3/122; A43B 3/128; A43B 3/24; A43B 3/242; A43B 3/244

USPC ..... 36/11.5, 100, 101

See application file for complete search history.

(56) References Cited

U.S. PATENT DOCUMENTS

| | | | | |
|---|---|---|---|---|
| 5,802,738 | A * | 9/1998 | Ferniani | A43B 3/103 36/101 |
| 8,448,351 | B2 * | 5/2013 | Aveni | A43B 3/103 36/101 |
| 9,961,956 | B2 * | 5/2018 | Williams | A43B 3/24 |
| 2005/0016018 | A1 * | 1/2005 | Cagner | A43B 3/103 36/11.5 |
| 2008/0022557 | A1 * | 1/2008 | Hearn | A43B 3/103 36/94 |
| 2011/0099840 | A1 * | 5/2011 | Aveni | A43B 3/103 36/11.5 |
| 2013/0019496 | A1 * | 1/2013 | Mizrahi-Shapiro | A43B 1/0027 36/11.5 |
| 2013/0160325 | A1 * | 6/2013 | Moon | A43B 1/0027 36/100 |

(Continued)

*Primary Examiner* — Marie D Bays

(74) *Attorney, Agent, or Firm* — Kirton McConkie; Evan R. Witt

(57) ABSTRACT

The footwear includes a sole having three holes passing through the sole. A front channel, a first rear channel and a second rear channel are formed in an underside of the sole. The footwear also includes of a strap having a front plug, a first rear plug, and a second rear plug connected to the strap. Each of the three holes in the sole are aligned with respective channels to enable the three respective plugs to pass through each respective hole. The three plugs are releasably attached to the sole and configured to allow a user's foot to be located between the strap and the sole. Each respective plug is completely located within a respective channel such that each respective plug sits flush with the underside of the sole to secure the strap to the sole. The three channels and the three plugs are of complementary size and shape.

15 Claims, 11 Drawing Sheets

(56) References Cited

U.S. PATENT DOCUMENTS

| | | | | |
|---|---|---|---|---|
| 2013/0305563 | A1* | 11/2013 | Aveni | A43B 3/103<br>36/11.5 |
| 2014/0352171 | A1* | 12/2014 | Hillyer | A43B 3/0078<br>36/11.5 |
| 2015/0223551 | A1* | 8/2015 | Munro | A43B 3/103<br>36/11.5 |
| 2017/0258174 | A1* | 9/2017 | Williams | A43B 3/24 |

* cited by examiner

FOOTWEAR

CROSS REFERENCE TO RELATED APPLICATIONS

This application is a continuation-in-part application of U.S. patent application Ser. No. 14/176,513 filed on Feb. 10, 2014, which is incorporated herein by reference.

FIELD OF THE INVENTION

This invention generally relates to footwear. In particular, the invention relates to footwear including flip-flops, sandals, slippers, scuffs and the like.

BACKGROUND OF THE INVENTION

It should be noted that reference to the prior art herein is not to be taken as an acknowledgement that such prior art constitutes common general knowledge in the art.

Flip flops are one of the most common types of sandals, where two ends of a Y-shaped strap are attached to the sole of the sandal on the opposite sides of the sole where a wearer's foot would rest, with the two ends intersecting at a thong or toe piece extending from the sole for placement between the big or first toe and the second toe of the wearer's feet. This configuration of sandal straps contributes to the common name of "flip-flops" due to the slapping of the sole against the heel that occurs while walking.

Flip-flops are a very popular form of footwear due to their ease of placement and removal on a person's foot. Historically, flip-flops have been used as casual wear, especially in warmer climates. However, in recent times, flip-flops have become an essential footwear fashion item with a variety of different patterns, styles and colours being used to enhance the visual characteristics of flip-flops.

In order to produce a flip-flop, three holes are normally located through the sole with circular recesses located on the underside of the sole adjacent each of the holes. The strap has a central portion and two side portions with an end of each of the portions terminating in a circular head. The heads are forced through respective holes and are located within the circular recesses to hold the strap and the sole together.

The problem with the manufacture of a flip-flop is that it is relatively difficult to pull the circular heads through the respective holes in the sole. A special tool must be used and considerable physical strength is required. Also, in general use, the circular heads can be pulled through the holes leaving an individual to try and force the circular head back through the hole without the use of the tool.

It has also been proposed in the past to manufacture sandals and shoes with interchangeable and removable elements, but these prior art devices are normally quite complicated and difficult to provide for the interlocking of the elements Clearly it would be advantageous if footwear could be devised that helped to at least ameliorate some of the shortcomings described above or provide the consumer with a useful or commercial choice.

SUMMARY OF THE INVENTION

In accordance with a first aspect, the present invention provides a footwear comprising: a sole able to be located under the foot of a user, the sole having three holes passing through the sole; a front channel and a first rear channel and a second rear channel formed in an underside of the sole; a strap of unitary construction having two side portions which join to form a central portion, the strap having a front plug, a first rear plug and a second rear plug connected to the two side portions and integrally formed with the strap, the front plug, the first rear plug and the second rear plug are tapered and have two sections unequally spaced from either side of a central portion and formed at an angle with respect to the central portion, the three plugs are releasably attached to the sole and configured to allow the foot of the user to be located between the strap and the sole; and wherein each of the three holes in the sole are aligned with one of the front channel, the first rear channel and the second rear channel so as to allow the front plug, the first rear plug and the second rear plug to pass and be threaded through each respective hole, the first rear plug which when located in said first rear channel and the second rear plug when located in said second rear channel extend partially along a length of the sole, and each respective plug is completely located within each of the respective channels such that each respective plug sits flush with the underside of the sole to secure the strap to the sole, the three channels and the three plugs are of complementary size and shape, and the strap, three plugs and sole are interchangeable or configured to be changed without the use of tools.

Preferably, said front plug when located in said front channel may extend partially across the width of the sole.

Preferably, the two sections may form an apex at the central portion. Each plug may have a long section and a short section. The long section and the short section of the plug may be shaped as flat elongate, longitudinally curvilinear strips which are joined to form an apex at the central portion. Alternatively, each plug may be formed in the shape of an irregular concave curvilinear quadrilateral.

Preferably, each plug may have an inner surface and an outer surface separated and spaced apart by a wall joining the inner surface to the outer surface.

Preferably, the front channel, the first rear channel and the second rear channel formed in the underside of the sole may have a long section and a short section joined at a central portion. The long section and the short section may have a bottom surface spaced a distance from the underside of the sole and forming a wall extending around and between the bottom surface and the underside of the sole.

Preferably, when each complementary shaped plug is inserted into each channel, the inner surface of each plug and the plug wall may be frictionally engaged with the bottom surface and the channel wall of each channel and the outer surface of each plug is so aligned to sit flush with the underside of the sole.

Preferably, when each complementary shaped plug is inserted into each channel, the inner surface of each plug and the plug wall is frictionally engaged with the bottom surface and the channel wall of each channel, allows each plug to be retained within each channel without the need for any secondary retention means. Preferably, the strap and integrally connected plugs located within each channel in the underside of the sole are interchangeable without the need for tools.

Preferably, the first rear channel may extend partially along a long axis of the sole and adjacent a side of the sole. The second rear channel may extend partially along a long axis of the sole and adjacent a side of the sole.

The long section of the first rear channel and the short section of the second rear channel may be located in adjacent positions on opposing sides of the sole. The short section of the first rear channel and the long section of the second rear channel may be located in adjacent positions on opposing sides of the sole.

In accordance with a further aspect, the present invention provides a footwear comprising: a sole able to be located under the foot of a user, the sole having three holes passing through the sole; a front channel and first and second rear channels formed in an underside of the sole; a strap able to locate the sole under the foot of a user, the strap having three plugs; and wherein each of the three holes in the sole are aligned with respective channels so as to allow the three respective plugs to pass through each respective hole to be located in each of the respective channels to secure the strap to the sole.

Preferably, the strap may be of unitary construction. The strap and three plugs connected to the strap may be formed integrally with the strap. The three plugs and three channels may be shaped and sized such that the three plugs sit flush with the underside of the sole when located in respective channels. Alternatively, the three channels and the three plugs may have complementary size and shape such that the three plugs are frictionally retained in the three channels.

Preferably, the strap may include at least two side portions. The two side portions may be connected to the front plug and the respective rear plugs. The strap may be formed by a pair of side portions which join to form a central portion. Preferably, the plugs may be tapered so as to allow the plugs to be threaded through their respective holes.

Preferably, the front plug when located in said front channel may extend partially across the width of the sole. The first rear plug and second rear plug when located in said channels may extend partially along the length of the sole.

Preferably, each plug may have two sections equally spaced either side of a central portion. Alternatively, each plug may have two sections unequally spaced either side of a central portion. Further alternatively, each plug may have two sections which are formed at an angle with respect to a central portion. Preferably, the two sections may form an apex at the central portion. Each plug may have a long section and a short section.

In accordance with a still further aspect, the present invention provides a method for assembling footwear, the method comprising the steps of: a) providing a strap comprising a front plug, a first rear plug and a second rear plug, each plug having a first section and a second section; b) providing a sole comprising a front hole, a first rear hole, a second rear hole, a front channel, a first rear channel and a second rear channel, wherein the channels are on an underside of the sole; c) inserting the first sections of each of the plugs through the respective holes of a topside of the sole until each of the plugs pass completely through; d) locating each of the plugs into their respective channels such that the plugs are flush with the underside of the sole.

In accordance with a still further aspect, the present invention provides a method for disassembling footwear, the method comprising the steps of: a) providing an assembled footwear comprising a strap which further comprises: a front plug, a first rear plug and a second rear plug, each having a first section and a second section; a sole comprising a front hole, a first rear hole, a second rear hole, a front channel, a first rear channel and a second rear channel, wherein the channels are on an underside of the sole; b) removing the plugs from their respective channels; and c) inserting the second sections of each of plugs through their respective holes of an underside of the sole until each of the plugs pass completely through, disengaging the strap from the sole.

BRIEF DESCRIPTION OF THE DRAWINGS

An embodiment of the invention, by way of example only, will be described with reference to the accompanying drawings in which.

DETAILED DESCRIPTION OF THE PREFERRED EMBODIMENT

Figure 1:
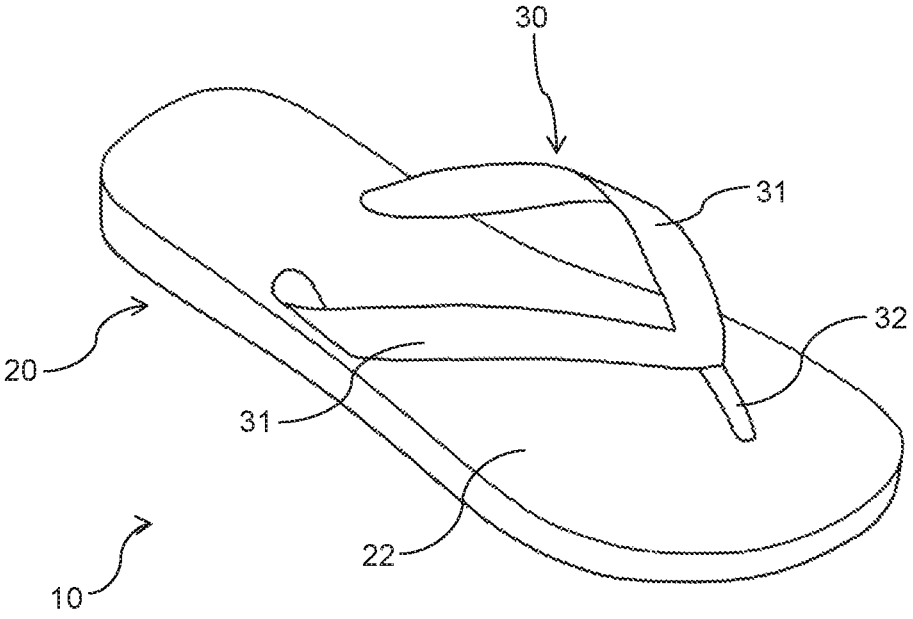
FIG. 1 shows a top perspective view of an embodiment of the present invention in the form of an assembled flip-flop.

The following description, given by way of example only, is described in order to provide a more precise understanding of the subject matter of a preferred embodiment or embodiments.

In its most general form the footwear or flip-flop 10 comprise a sole 20 and a unitary interchangeable strap 30. The sole 20 is able to be located under the foot of a user and has three holes 26, 44, 46 passing through the sole 20. The sole has a top side 22 and an underside 23. In the underside 23 three channels are formed; a front channel 24 and a first rear channel 40 and a second rear channel 42. The interchangeable strap 30 has three plugs 34, 48, 50 connected to the strap 30. The three plugs 34, 48, 50 and the strap 30 are releasably attached to the sole 20 and configured to allow the foot of the user to be located between the strap 30 and the sole 20. Each of the three holes 26, 44, 46 in the sole 20 are aligned with respective channels 24, 40, 42 so as to allow the three respective plugs 34, 48, 50 to pass through each respective hole 26, 44, 46, and each respective plug 34, 48, 50 is completely located within each of the respective channels 24, 40, 42 such that each respective plug sits flush with the underside 23 of the sole 20 to secure the strap 30 to the sole 20. The three channels 24, 40, 42 and the three plugs 34, 48, 50 are of complementary size and shape to enable the channels and plugs to frictionally engage each other. The strap 30 and its associated three plugs 34, 48, 50, and sole 20 are interchangeable or configured to be changed with other straps and soles without the use of tools.

The releasably attached strap 30 and sole 20 are interchangeable in that other straps 30 and other soles 20 are capable of being put or used in the place of each other. For example, straps 30 may be supplied in different colours and with different designs on the straps 30. This allows the user to easily change the look of the footwear 10 by simply changing the current strap 30 for a new strap 30. This is also the case for different coloured soles 20 which may be interchangeable should the user require a different colour combination or a different design on the sole 20.

Therefore in order to be interchangeable the plugs 34, 48, 50 are releasably attached to the sole 20. This means the plugs 34, 48, 50 are brought into direct contact with and retained within the channels 24, 40, 42 for frictional engagement. The surfaces of the plugs 34, 48, 50 frictionally engage with the surfaces of the channels 24, 40, 42 to releasably retain the strap 30 to the sole 20.

Figure 4:
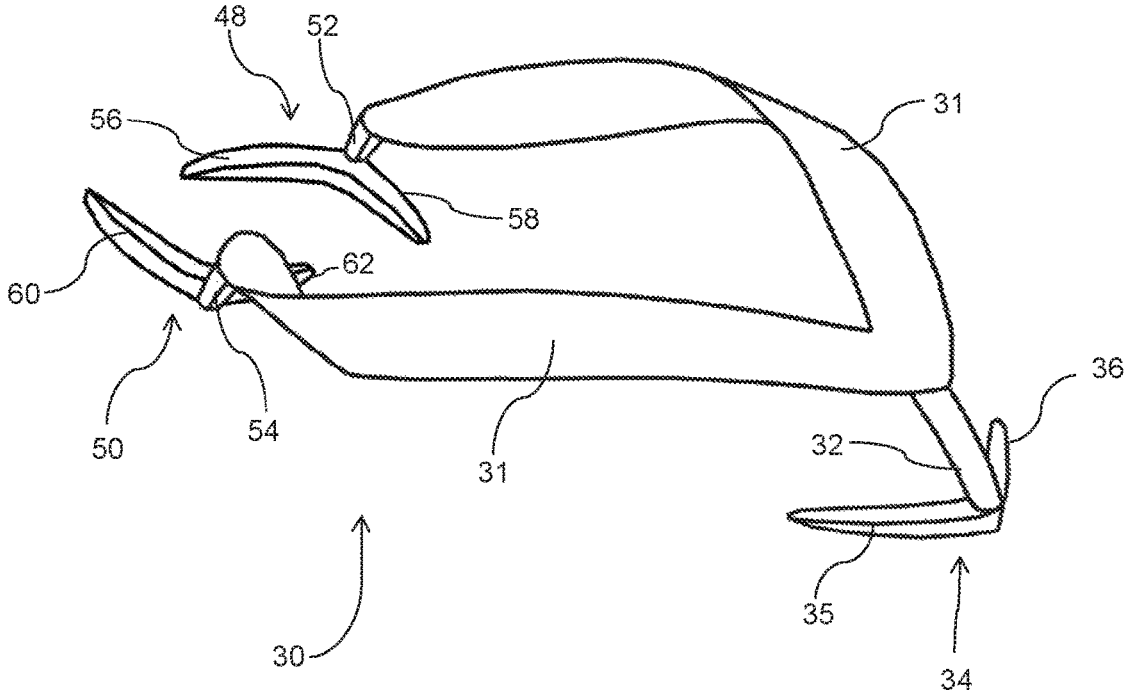
FIG. 4 shows a top perspective view of a strap of the footwear according to FIG. 1.

FIGS. 1 to 4 show views of an embodiment of footwear in the form of a flip-flop 10. The figures show variations of both a left foot flip flop in FIG. 2 and a right foot flip flop in FIGS. 1 and 3. FIG. 4 shows the strap 30 for the flip flop 10. FIG. 1 shows the assembled flip flop 10 having a sole 20 and a strap 30. The sole 20 is shaped in a standard sole shape. However, it should be appreciated that the sole may be formed in any number of different shapes and sizes. It should also be appreciated that the materials used for the sole 20 can include any standard material that is currently used on footwear, such as rubber, cork and a variety of plastics.

The sole 20 is formed from a main body that has a top side 22 and an underside 23. A front channel 24 extends partially along the width of the underside 23 of the sole 20. A front hole 26 extends through the top side 22 of the sole 20 through to the underside 23 of the sole 20. The front hole 26 is rectangular in shape and is positioned so that the front hole 26 is in alignment with the front channel 24. It should be appreciated, however, that the front hole 26 may form any suitable shape, such as square or circular.

The strap 30 as shown in FIG. 4 is formed from two side portions 31 which are joined to form a central portion 32. Rear plugs 48, 50 extend from one end of either side portion 31. A front plug 34 is connected to and located adjacent an end of the central portion 32. Both the front plug 34 and rear plugs 48, 50 are shaped and sized to commensurate with the respective front channel 24 and rear channels 40, 42 of the sole 20. All three plugs 34, 48, 50 and all three channels 24, 40, 42 are of complementary shape and size thus allowing the releasable strap 30 to be interchangeable with the sole 20 of the footwear 10. As illustrated the plugs 34, 48, 50 and the channels 24, 40, 42 are all of the same shape and size. Each plug 34, 48, 50 has two sections unequally spaced from either side of a central portion and formed at an angle with respect to a central portion. Each plug 34, 48, 50 has a long section and a short section and are shaped as flat airfoils or wings joined to form an apex at the central portion and similar in shape to a boomerang. In geometric terms the long and short sections of each plug is shaped as a flat elongate, longitudinally curvilinear strip, the strips being joined to form an apex at the central portion. The overall shape of the two sections joined at the apex is in the shape of an irregular concave curvilinear quadrilateral. The plugs 34, 48, 50 and strap 30 will be described in further detail below.

The strap 30 is integrally formed. That is, the strap 30 is unitary in construction. Accordingly, any suitable material can be used, including rubber or plastics such as polyurethane. The strap 30 of FIG. 4 comprises a first rear plug 48 and a second rear plug 50. Both the first rear plug 48 and second rear plug 50 are similar in both size and shape to the front plug 34.

Figure 2:
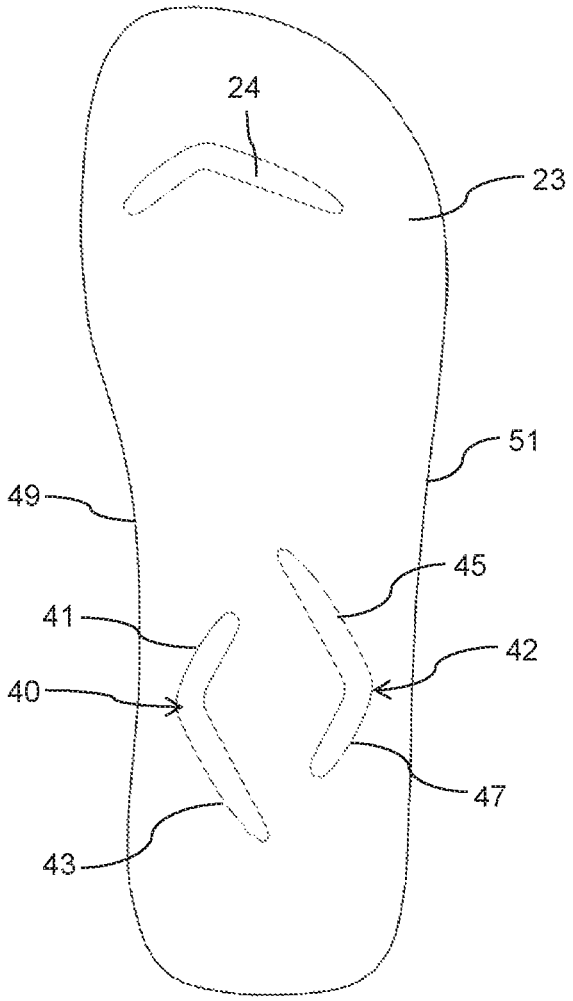
FIG. 2 shows a bottom plan view of the footwear according to FIG. 1.
Figure 3:
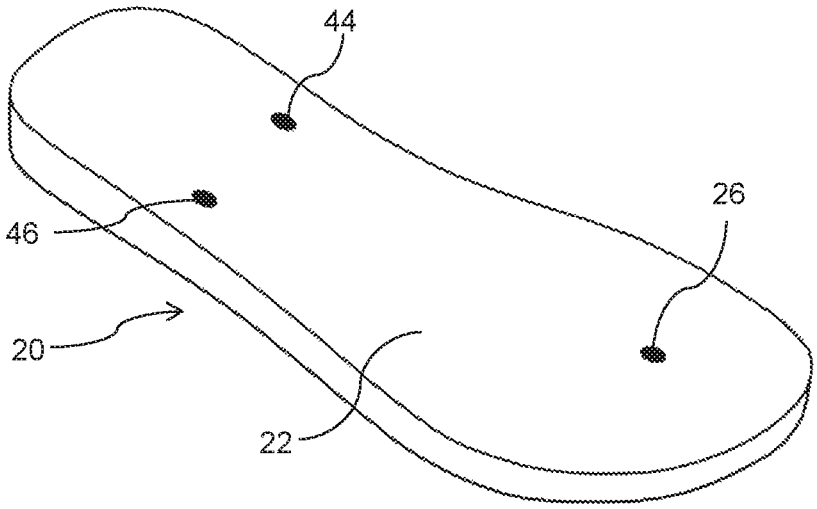
FIG. 3 shows a top perspective view of a sole of the footwear according to FIG. 1.

FIG. 2 shows a front channel 24 which partially extends along the width of the underside 23 of the sole 20. The front plug 34 comprises a long section 35 and a short section 36. The long section 35 and the short section 36 are tapered to allow the front plug 34 to be easily threaded through front hole 26. The long section 35 and the short section 36 intersect at a central portion 32, the sections 35, 36 forming an angle with the central portion 32 and extending away from the central portion 32. It should be appreciated, however, that the long section 35 and the short section 36 may not form an angle at the intersection of the long section 35 and the short section 36.

A first rear channel 40 is located adjacent to a first side 49 and a second rear channel 42 adjacent to a second side 51 extend essentially parallel to the long axis of the sole 20 and along the underside 23 of the sole 20. It should be appreciated that the two rear channels 40 and 42 need not be essentially parallel to the long axis of the sole 20, but should be configured on the underside 23 such that the two rear channels 40 and 42 do not intersect. In this embodiment a long section 43 of the first rear channel 40 is adjacent to a short section 47 of the second rear channel 42. Further a short section 41 of the first rear channel 40 is adjacent to a long section 45 of the second rear channel 42. This configuration provides a means to separate the two channels 40 and 42 maximally.

Figure 5:
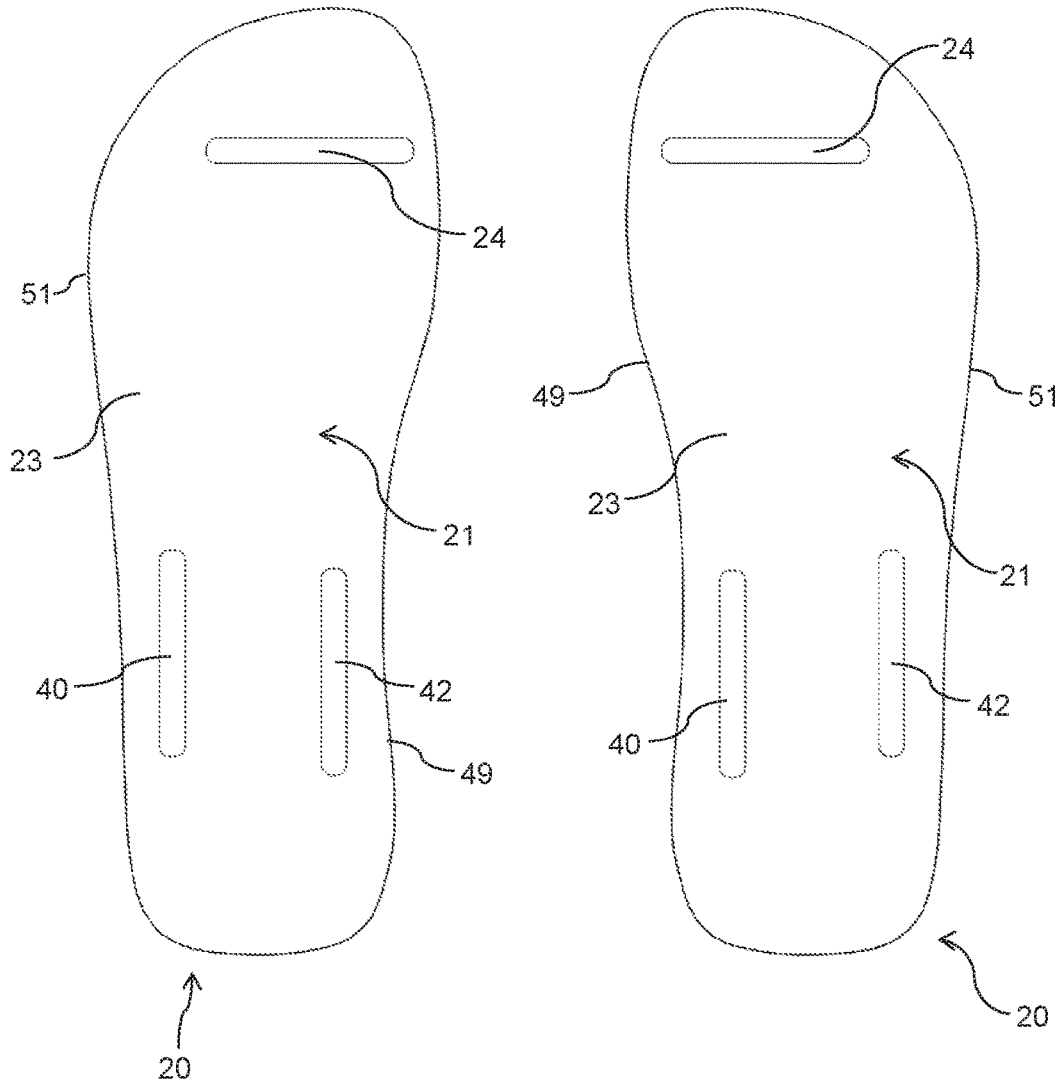
FIG. 5 illustrates a bottom plan view of a further embodiment of the present invention in the form of a flip-flop.
Figure 6:
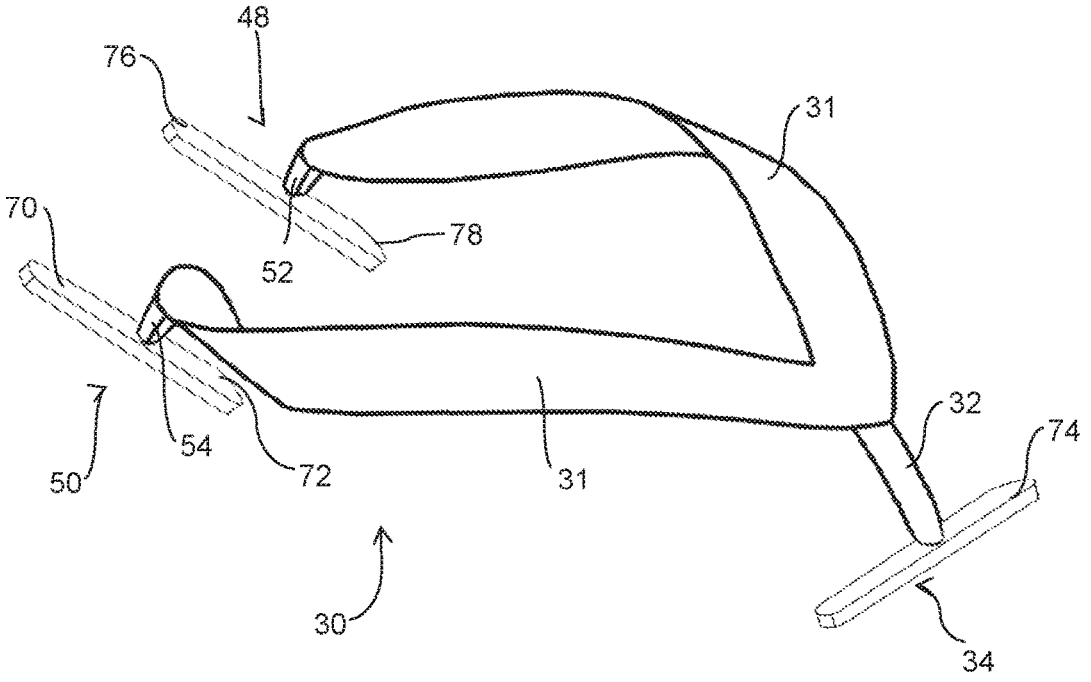
FIG. 6 shows a top perspective view of a strap of the footwear according to FIG. 5.

FIGS. 5 and 6 show views of a further embodiment of footwear in the form of a flip-flop. Like the previous embodiment the sole 20 is shaped in a standard sole shape and formed from a main body that has a top side (not shown) and an underside 23. A front channel 24 extends partially along the width of the underside 23 of the sole 20. A front hole extends through the top side of the sole 20 through to the underside 23 of the sole 20. The front hole is rectangular in shape and is positioned so that the front hole is in alignment with the front channel 24. It should be appreciated, however, that the front hole may form any suitable shape, such as square or circular.

The strap 30 as shown in FIG. 6 is formed from two side portions 31 which are joined to form a central portion 32. Rear plugs 48, 50 extend from one end of either side portion 31. A front plug 34 is connected to and located adjacent an end of the central portion 32. Both the front plug 34 and rear plugs 48, 50 are shaped and sized to be commensurate with the respective front channel 24 and rear channels 40, 42 of the sole 20. The strap 30 is integrally formed. That is, the strap 30 is unitary in construction. Accordingly, any suitable material can be used, including rubber or plastics such as polyurethane. The strap 30 of FIG. 6 comprises a first rear plug 48 and a second rear plug 50. Both the first rear plug 48 and second rear plug 50 are similar in both size and shape to the front plug 34. The front plug 34 when located in the front channel 24 extends partially across the width of the sole 20. Likewise the first and second rear plugs 48, 50 when located in their respective rear channels 40, 42 extend partially along the length of the sole 20 and adjacent to their respective sides 49, 51 of the sole 20. In FIG. 6 each plug 48, 50 consists of two sections 70, 72 and 76, 78 which are equally spaced either side of a central portion 52, 54. Alternatively, each plug 48, 50 may consist of two sections 70, 72 and 76, 78 which are unequally spaced either side of a central portion 52, 54. That is the portions 70, 72 and 76, 78 may be of different lengths on either side of the central portions 52, 54.

The front plug 34 and its respective front channel 24 may be non-linear, as shown in FIGS. 2 and 4 or generally linear, as shown in FIGS. 5 and 6. Likewise, the first and second rear plugs 48, 50 and their respective rear channels 40, 42 may be non-linear as shown in FIGS. 2 and 4 or generally linear, as shown in FIGS. 5 and 6.

In order to disassemble and assemble the flip flop, the same process is used as was explained above for the previous embodiment.

Figure 7:
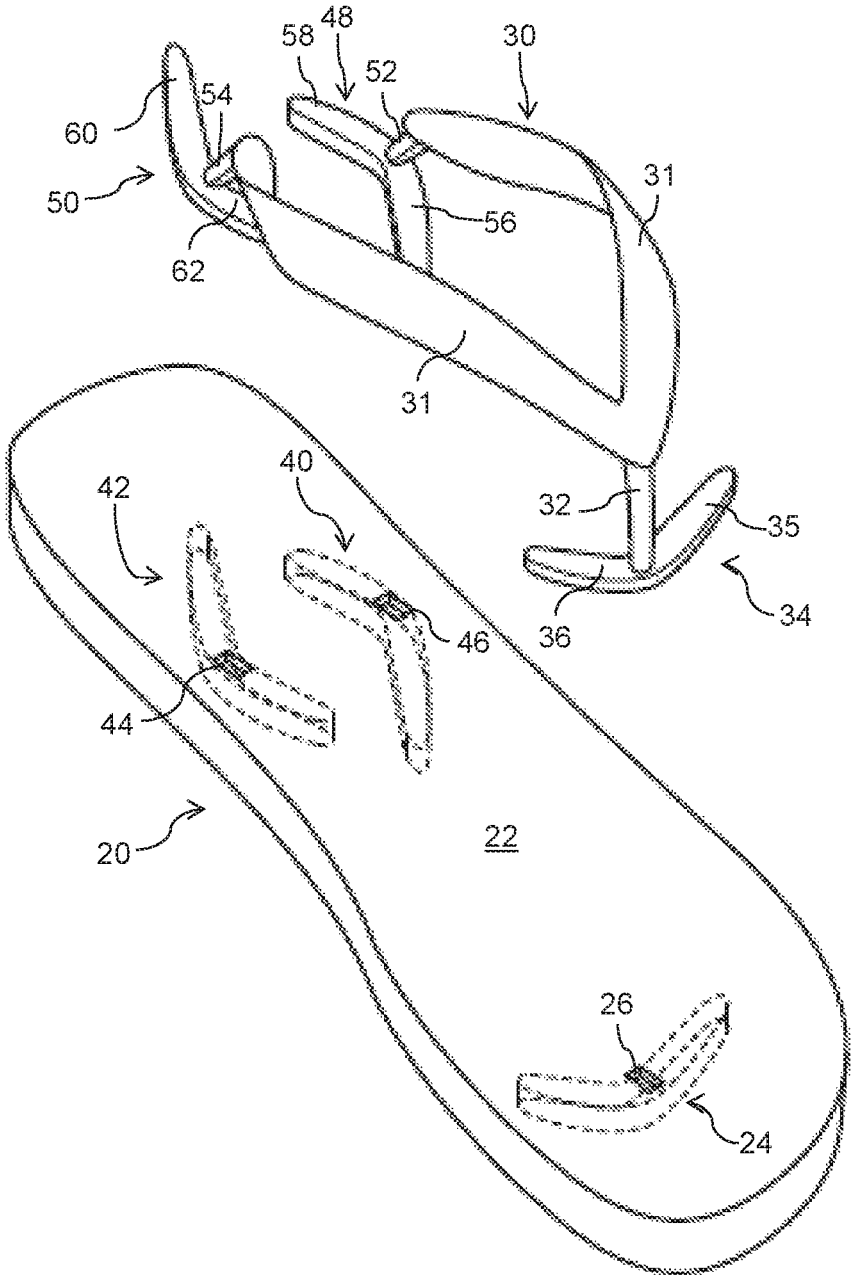
FIG. 7 shows a disassembled top view of the footwear of FIG. 1.
Figure 8:
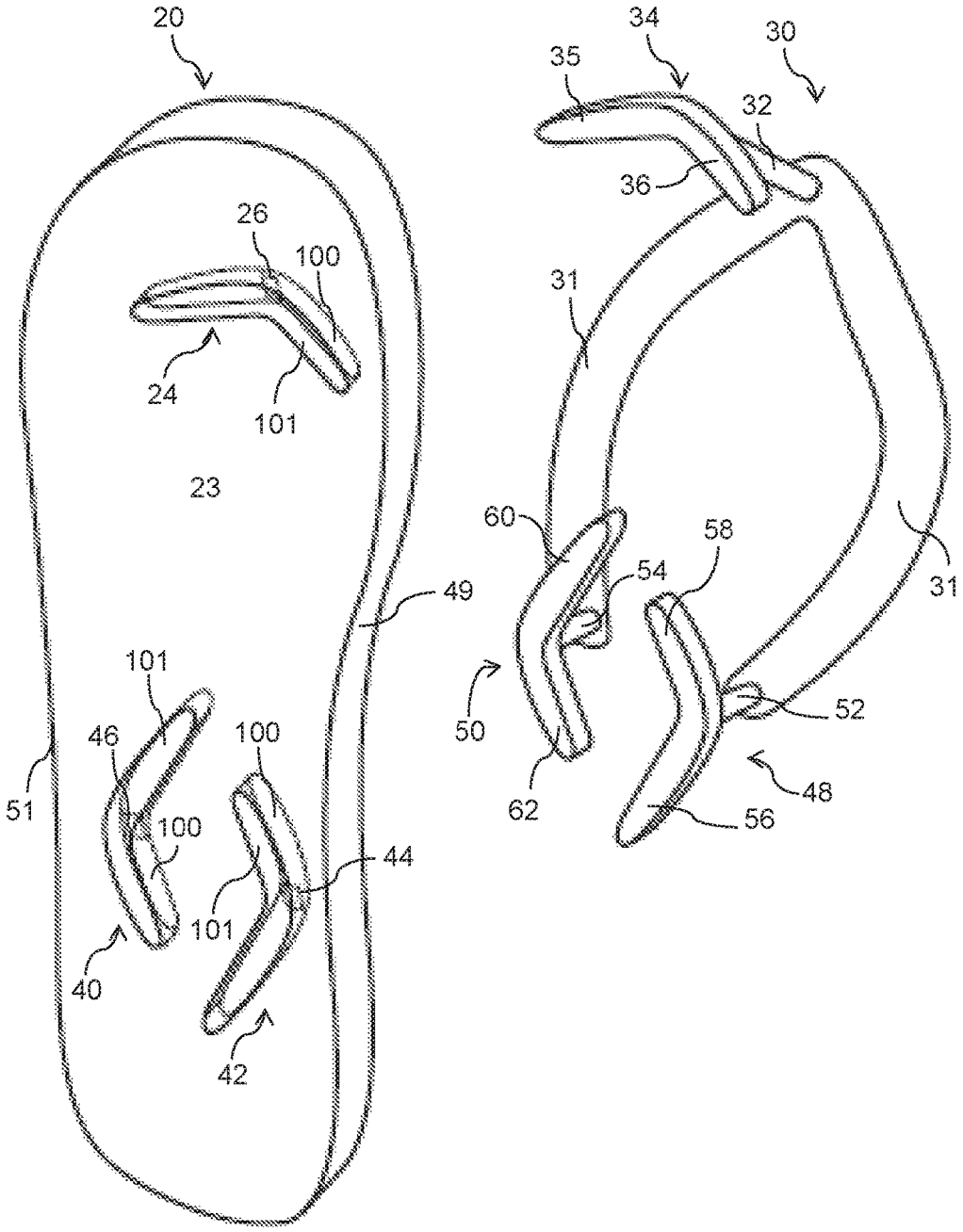
FIG. 8 shows a disassembled bottom view of the footwear of FIG. 1.

FIGS. 7 and 8 show front and rear views of the interchangeable strap 30 disassembled from the sole 20. The only notable differences between FIGS. 7 and 8 and FIGS. 1 to 4 are the holes 26, 44, 46 in the sole 20 are rectangular in shape for receiving similar rectangular shaped central portions 32, 52, 54. As shown in FIG. 7 the holes 26, 44, 46 extend a short distance into the sole 20 until they come in contact with the inner surface 100 of the channels 24, 40, 42.

FIG. 8 shows the rear or bottom view of the interchangeable strap 30 disassembled from the sole 20. As illustrated the channels 24, 40, 42 are formed within the underside 23 of the sole 20. Each channel 24, 40, 42 has an open end which is in the same plane as the underside 23 of the sole 20 and an inner surface 100 which is joined to the open end by wall 101. The channels 24, 40, 42 extend a distance into and are spaced from the underside 23 of the sole 20. The distance which the channels 24, 40, 42 extend into the sole 20 is comparable with the height of each plug 34, 48, 50. When the strap 30 and plugs 34, 48, 50 are assembled and the plugs are located within the channels the outer surface 91, 96 of the plugs lies in the same plane or is aligned with the underside of the sole 23.

The interchangeability of the releasable strap 30 and the sole 20 allows for easy assembly and disassembly of the footwear 10. The assembly of the releasable strap 30 to the sole 20 will be described below and illustrated in FIGS. 9 to 11. The disassembly of the releasable strap 30 from the sole 20 will also be described below and illustrated in FIGS. 12 to 14.

Figure 9:
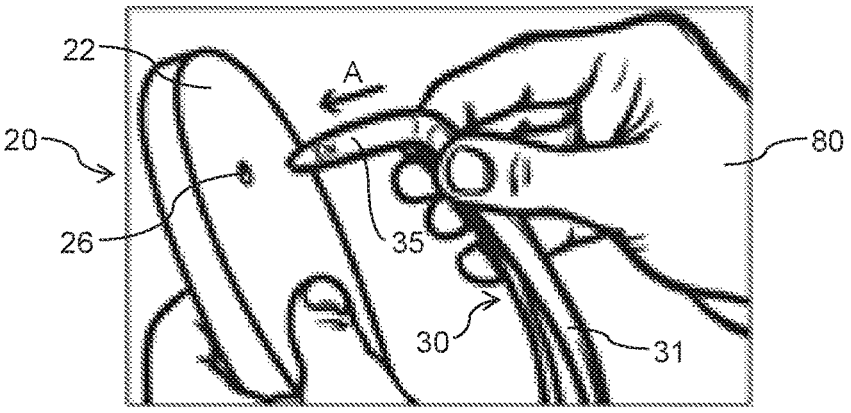
FIGS. 9 to 11 illustrate the steps in assembling the footwear of FIG. 1 with the interchangeable strap being attached to the sole to form the footwear.
Figure 10:
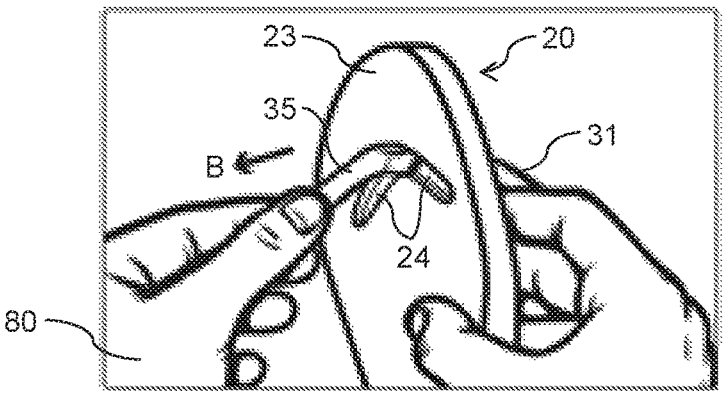
Figure 11:
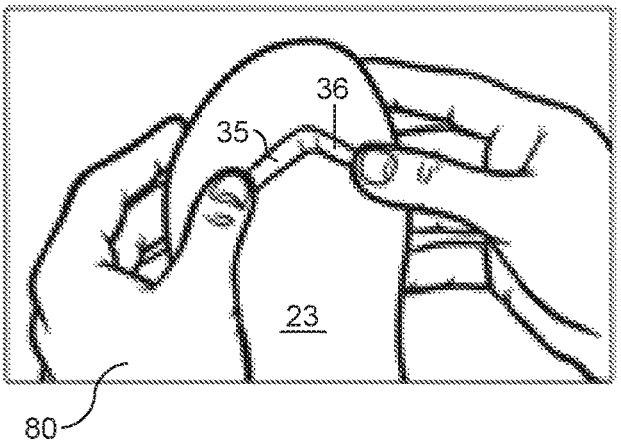

FIGS. 9 to 11 show the assembly of the footwear 10. In order to assemble a flip-flop 10, the long section 35 of the front plug 34 is placed and pushed by a user 80 into the front hole 26 in the sole 20 in the direction of arrow A. The long section 35 and the front plug 34 are then pulled through the front hole 26, this includes the short section 36. As the front plug 34 is pulled through the front hole 26 in the direction of arrow B, a part of the central portion 32 will also be pulled through the front hole 26. Once the front plug 34 is pulled entirely through the front hole 26, the front plug 34 is located completely within the front channel 24 such that the outer side of the front plug 34 will be aligned with the underside 23 of the sole 20. As illustrated in FIG. 11 the front plug 34 is pushed firmly into the channel 24 such that the front plug 34 is frictionally engaged with the front channel 24 to releasably retain the front plug 34 within the front channel 24. The method of engagement of the rear plugs 48 and 50 with the channels 40 and 42 is the same as described above for the front plug 34 engaging with front channel 24. The rear plugs 48 and 50 are inserted into their respective channels through respective holes, a first rear hole 44 and a second rear hole 46, in the sole 20. The rear plugs 48 and 50 comprise long sections 56 and 60 respectively and short sections 58 and 62 respectively. Like the front plug 34 both rear plugs 48 and 50 of the strap 30 are shaped complimentarily to the rear channels 40 and 42 to provide a means for engagement for the rear plugs 48 and 50 to the rear channels 40 and 42 of the sole 20.

Figure 12:
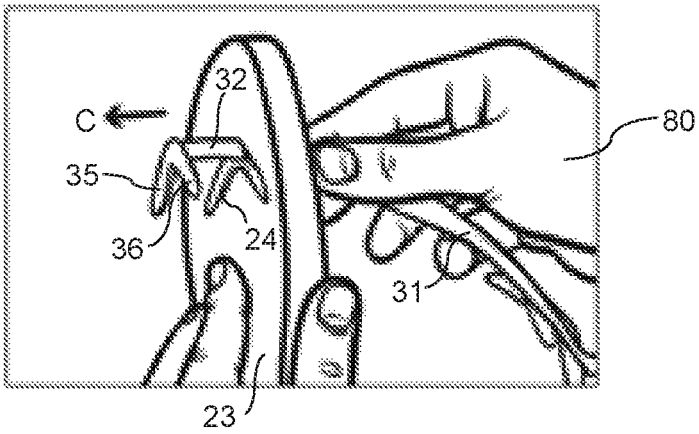
FIGS. 12 to 14 illustrate the steps in disassembling the footwear of FIG. 1 with the interchangeable strap being removed from the sole.
Figure 13:
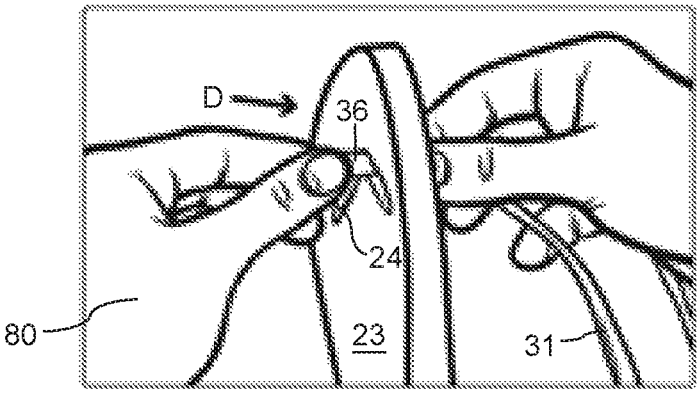
Figure 14:
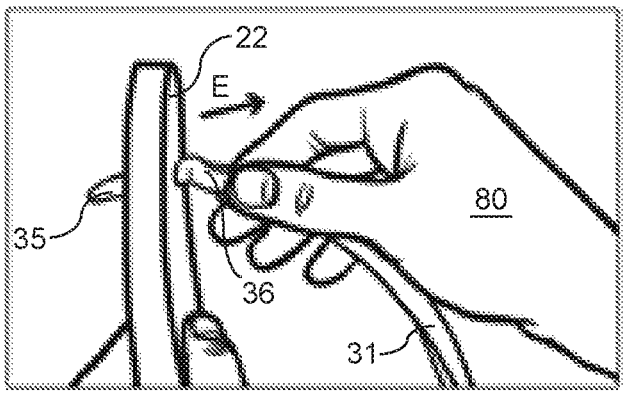

FIGS. 12 to 14 show the disassembly of the footwear 10. In order to remove the strap 30 from the sole 20, the following steps are performed. Firstly, each plug 34, 48, 50 is pushed in the direction of arrow C by the user 80 and out of frictional engagement with each channel 24, 40, 42. The short section 36, 58, 62 of each plug 34, 48, 50 is then folded towards the central portion 32, 52, 54 and pushed through the holes 26, 44, 46 in the direction of arrow D. The plugs 34, 48, 50 are then pulled completely through the holes in the direction of arrow E of FIG. 14. For example, removal is achieved by inserting short sections 36, 58, 62 through holes 26, 44, 46 and pushing until the plugs 34, 48, 50 disengage from the sole 20.

To facilitate the assembly and disassembly of the flip flop 10 the long sections 35, 56 and 60 may be labeled "IN" indicating to a user 80 that the long section is used to insert the plugs 34, 48 and 50. Likewise, the short sections 36, 58, 62 may be labeled "OUT" indicating to the user that this end is threaded first to dissemble the flip-flop 10. The short sections and the long sections on the plugs make the flip-flop 10 easier to assemble and disassemble.

Figure 15:
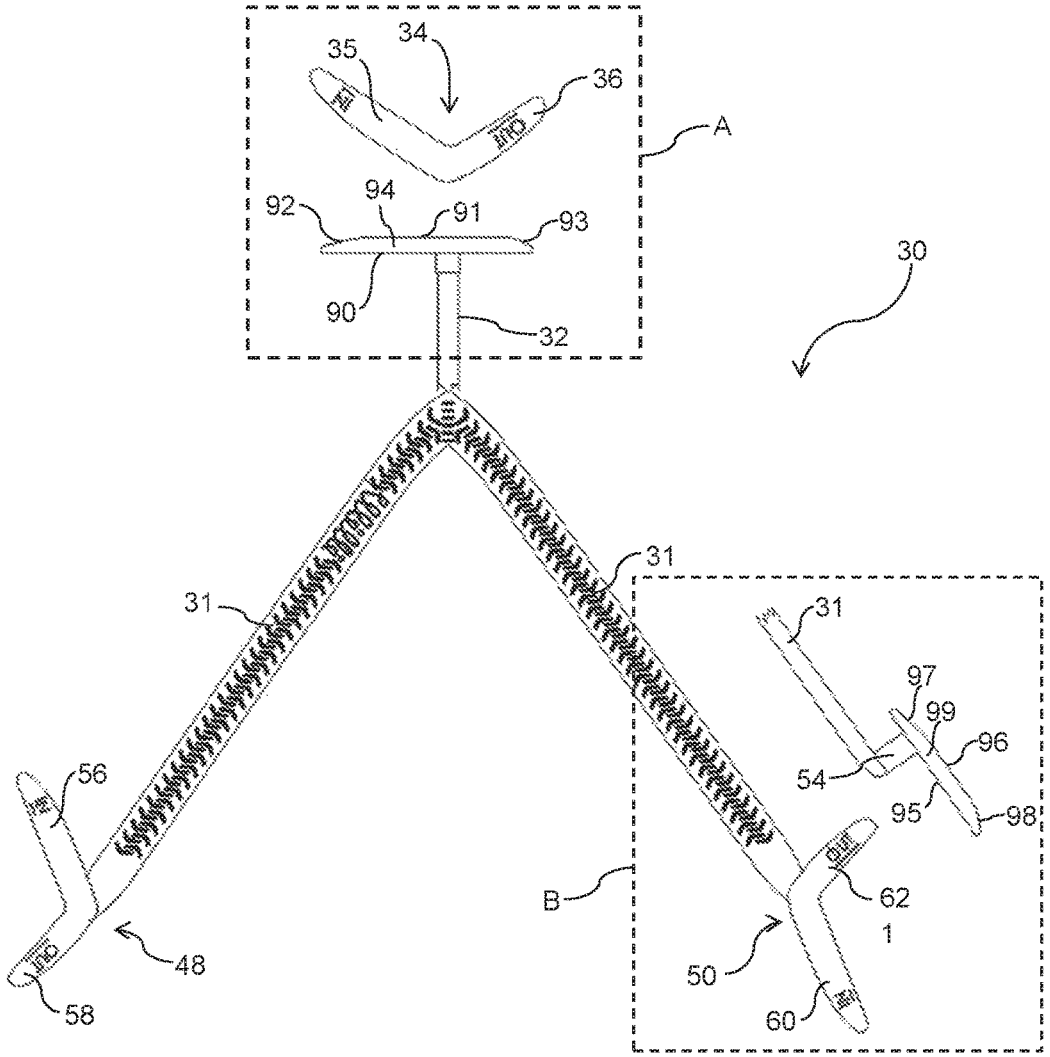
FIG. 15 shows a top view of the strap of FIG. 4 and showing further detail of the plugs in A and B.

FIG. 15 shows a more detailed releasable strap 30 showing as described above a strap 30 of unitary construction formed from two side portions 31 which are joined to form a central portion 32. Rear plugs 48, 50 extend from one end of either side portion 31.

As highlighted in box A and extending from the central portion 32 is the front plug 34 with it long section 35 and short section 36 coming together to join at the apex and end of the central portion 32. The front plug 34 has an outer surface 91 and an inner surface 90 which are joined by wall 94 which extends around the plug 34. Either end of the outer surface 91 is tapered 92, 93 to allow for the easy insertion at end 92 and easy extraction at end 93.

As highlighted in box B and extending from side portion 31 and central portion 54 is rear plug 50. As rear plug 50 is identical to rear plug 48 only one side will be described. Like the front plug 34 both the rear plugs 48, 50 are the same shape and size. The rear plug 50 has an outer surface 96 and an inner surface 95 which are joined by wall 99 which extends around the plug 50. Either end of the outer surface 96 is tapered 97, 98 to allow for the easy insertion at end 98 and easy extraction at end 97.

All three plugs 34, 48, 50 and all three channels 24, 40, 42 are of complementary shape and size thus allowing the releasable strap 30 to be interchangeable with the sole 20 of the footwear 10. As shown in FIGS. 7 and 8 described above the front plug 34 is pulled through the front hole 26, a part of the central portion 32 will also be pulled through the front hole 26. Once the front plug 34 is pulled entirely through the front hole 26, the front plug 34 is located completely within the front channel 24 such that the outer side 91 of the front plug 34 will be aligned with the underside 23 of the sole 20. The front plug 34 is then pushed firmly into the channel 24 such that the inner surface 90 and the wall 94 of the front plug 34 are in contact with and frictionally engaged with the inner surface 100 and wall 101 of the front channel 24 to releasably retain the front plug 34 within the front channel 24.

The method of frictional engagement of the rear plugs 48 and 50 with the channels 40 and 42 is the same as described above for the front plug 34 engaging with front channel 24.

The plugs 34, 48, 50 and channels 24, 40, 42 have been described above to have a long section and a short section. The plugs 34, 48, 50 are shaped as flat elongate, longitudinally curvilinear strips which are joined to form an apex at the central portion 32, 52, 54. Likewise the channels 24, 40, 42 have a complementary size and shape for receiving the plugs 34, 48, 50 within. For example, the shape of the plugs is similar to that of the shape of an irregular concave curvilinear quadrilateral.

The straps 30 are made from any suitable material including rubber or plastics such as polyurethane and are provided in a wide range of colours and various patterns can be provided on the two side portion 31. Likewise the sole 20 may be formed in any number of different shapes, sizes and colours. It should also be appreciated that the materials used for the sole 20 can include any standard material that is currently used on footwear, such as rubber, cork and a variety of plastics.

Advantages

The advantage of the footwear embodiments described above is that the releasably attached strap can be placed within a sole very easily. This allows for quicker assembly time. Further, as the releasably attached strap can also be removed from the sole quickly without the use of tools, different interchangeable straps are able to be used with different soles to create a variety of different looks.

With the plugs frictionally engaged in each channel allows each plug to be retained within each channel without the need for any secondary retention means such as adhesive or glues. This further allows the releasable strap and integrally connected each plug to be interchangeable without the need for tools.

The present invention provides users with the ability to change their footwear straps and sole combination themselves without the need for tools. Having the ability to customise the user's footwear quickly means the user will always have the right look for any occasion. Mix and match colours to suit the user's outfit or favourite sporting team or charity. It is convenient for the user to take a few different coloured straps when the user goes on holidays and they do not require much luggage space.

The present invention provides affordable fashion that can be updated at a low cost each season. A number of different coloured soles and releasably attached straps provide an interchangeable range of footwear.

The design of the channels and plugs ensures that the strap is securely retained within the sole of the footwear. The unique complementary shape of the plugs and channels provides footwear which unlike it counterparts the plugs will not easily pull out of the channels. With the plugs frictionally retained within the channels they can only be removed by pushing the plug through the channel in the reverse direction and folding the short section of the plug and then pushing through the hole in the sole. The frictional engagement also means that no secondary retention devices like adhesives is required. The ability to releasably attach the plugs and strap to the sole also means that it is easily disassembled and reassembled without the needs of any tools.

It will also be appreciated that various other changes and modifications may be made to the embodiment described without departing from the scope of the invention.

VARIATIONS

It will be realized that the foregoing has been given by way of illustrative example only and that all other modifications and variations as would be apparent to persons skilled in the art are deemed to fall within the broad scope and ambit of the invention as herein set forth.

In the specification the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

The invention claimed is:

1. A footwear comprising:

a sole able to be located under the foot of a user, the sole having three holes passing through the sole;

a front channel and a first rear channel and a second rear channel formed in an underside of the sole;

a strap of unitary construction having two side portions which join to form a central portion, the strap having a front plug, a first rear plug and a second rear plug connected to the two side portions and integrally formed with the strap, the front plug, the first rear plug and the second rear plug are tapered and have two sections unequally spaced from either side of a central portion and formed at an angle with respect to the central portion, the three plugs are releasably attached to the sole and configured to allow the foot of the user to be located between the strap and the sole; and wherein each of the three holes in the sole are aligned with one of the front channel, the first rear channel and the second rear channel so as to allow the front plug, the first rear plug and the second rear plug to pass and be threaded through each respective hole, the first rear plug which when located in said first rear channel and the second rear plug when located in said second rear channel extend partially along a length of the sole, and each respective plug is completely located within each of the respective channels such that each respective plug sits flush with the underside of the sole to secure the strap to the sole, the three channels and the three plugs are of complementary size and shape, and the strap, three plugs and sole are interchangeable or configured to be changed without the use of tools.

2. The footwear as claimed in claim 1, wherein said front plug when located in said front channel extends partially across the width of the sole.

3. The footwear as claimed in claim 1, wherein the two sections of each respective plug form an apex at the central portion.

4. The footwear as claimed in claim 3, wherein each plug has a long section and a short section.

5. The footwear as claimed in claim 4, wherein the long section and the short section of the plug are shaped as flat elongate, longitudinally curvilinear strips which are joined to form an apex at the central portion.

6. The footwear as claimed in claim 5, wherein each plug is formed in the shape of an irregular concave curvilinear quadrilateral.

7. The footwear as claimed in claim 6, wherein each plug has an inner surface and an outer surface separated and spaced apart by a wall joining the inner surface to the outer surface.

8. The footwear as claimed in claim 1, wherein the front channel, the first rear channel and the second rear channel formed in the underside of the sole have a long section and a short section joined at a central portion.

9. The footwear as claimed in claim 8, wherein the long section and the short section have a bottom surface spaced a distance from the underside of the sole and forming a wall extending around and between the bottom surface and the underside of the sole.

10. The footwear as claimed in claim 9, wherein when each complementary shaped plug is inserted into each channel, the inner surface of each plug and the plug wall is frictionally engaged with the bottom surface and the channel wall of each channel and the outer surface of each plug is so aligned to sit flush with the underside of the sole.

11. The footwear as claimed in claim 10, wherein when each complementary shaped plug is inserted into each channel, the inner surface of each plug and the plug wall is frictionally engaged with the bottom surface and the channel wall of each channel, allows each plug to be retained within each channel without the need for any secondary retention means, and the integral connection between the strap and each plug being frictionally engaged with each channel, allows the strap and plugs to be interchangeable without the need for tools.

12. The footwear as claimed in claim 11, wherein the first rear channel extends partially along a long axis of the sole and adjacent a side of the sole.

13. The footwear as claimed in claim 12, wherein the second rear channel extends partially along a long axis of the sole and adjacent a side of the sole.

14. The footwear as claimed in claim 13, wherein the long section of the first rear channel and the short section of the second rear channel are located in adjacent positions on opposing sides of the sole.

15. The footwear as claimed in claim 14, wherein the short section of the first rear channel and the long section of the second rear channel are located in adjacent positions on opposing sides of the sole.

* * * * *